United States Patent [19]

Root

[11] 4,183,143

[45] Jan. 15, 1980

[54] LETTERING GUIDE

[76] Inventor: Raymond C. Root, 10241 N. 143 St., Waverly, Nebr. 68462

[21] Appl. No.: 933,966

[22] Filed: Aug. 15, 1978

Related U.S. Application Data

[63] Continuation-in-part of Ser. No. 834,476, Sep. 19, 1977, abandoned.

[51] Int. Cl.[2] ..... B41B 1/00

[52] U.S. Cl. ..... 33/184.5

[58] Field of Search ..... 33/180 R, 174 G, 184.5, 33/DIG. 9, 1 AA, 76 R, 95

[56] References Cited

U.S. PATENT DOCUMENTS 3,323,454 6/1967 McFarland ..... 33/184.5

*Primary Examiner*—Willis Little

*Attorney, Agent, or Firm*—Vincent L. Carney

[57] ABSTRACT

To position dry transfer lettering paper with respect to a document to be lettered, a lettering guide includes: (1) a platen having a flat document-mounting surface with guide flaps overlapping the surface; (2) a slide positioned between the flaps; and (3) self-adjusting mounting tracks on each end of the platen and slide to movably mount the two together. The document is mounted to the platen and the slide moves along a path guided by the mounting tracks over the document to establish lines for lettering. To position letters for transfer, the document-mounting surface of the platen has vertical lines on it and the slide has an upper edge with a guideline upon it which may be aligned with a guideline below the letters on the dry transfer lettering paper or the top or bottom edges of another row of letters on the paper and with indicia either on the slide or platen. The horizontal position (side-by-side) of the transfer letters is determined by the vertical lines on the platen and the vertical position of the slide.

10 Claims, 9 Drawing Figures

10
14
16
18
26
24
36A
36B
36C
38A
38B
38C
82
84
86
88A
88B
88C
88D
90
92
94
96
98
64
68

102
120
126
128
116
INCH SCALE
5 4 3 2 1
INCH SCALE
1 2 3 4 5
132
130
134
122
124
106
112
118
110
104
108
114
100
140
158
136
144
138
142
146
148
162

LETTERING GUIDE

This application is a continuation in part of U.S. patent application Ser. No. 834,476 filed Sept. 19, 1977, for LETTERING GUIDE by Raymond Charles Root, now abandoned.

This invention relates to guides, and more particularly to guides for positioning indicia for transfer to documents.

Dry transfer processes for transferring indicia to documents are used in certain printing applications requiring the printing of only a small number of copies, such as for example, the making of mock-ups prior to making a finished printed copy, or for making specialized displays or the like. In these processes, indicia such as lettering or designs are transferred directly to the poster or document, generally from transfer paper which is paper serving as a carrier for the indicia. As part of the transferring process, the letter or other indicia must be properly positioned with respect to other lines of printing or designs and with respect to adjacent printing or designs.

In the prior art, the indicia to be transferred have commonly been positioned on a document by first attaching the document to a drawing board and preparing guidelines on the document to aid in the proper location of the indicia. One prior art apparatus for quickly preparing guidelines is a drawing board with attached parallel bars or T-squares and the like which permit rapid drawing of the guidelines.

The prior art equipment for positioning indicia to be transferred have the disadvantages of being expensive and difficult to use by a layman, particularly if the indicia are to be transferred to a dark background. When the indicia are to be positioned on a dark background, it is difficult to draw guidelines for the letters on the background and even more difficult to remove them once drawn. Because of the difficulty in using the equipment, dry transfer processes have not generally been used by unskilled persons even though they would have been useful to them, particularly for specialized purposes such as the preparing of menus or special sales displays.

Accordingly, it is an object of this invention to provide a novel positioning guide for use in dry transfer processes.

It is a further object of the invention to provide a guide which enables the convenient positioning of indicia to be transferred to a document.

It is a still further object of the invention to provide an inexpensive guide for positioning indicia to be transferred to a document or poster.

It is a still further object of the invention to provide a portable apparatus which is relatively easy to use for positioning indicia to be transferred to other documents or the like.

In accordance with the above and further objects of the invention, the lettering guide of this invention includes a platen having a flat surface on which documents may be mounted and two side guides on opposite sides of the platen leaving between them a space for mounting the documents. A slide or cover is movably mounted to the side guides to maintain a horizontal attitude of an edge on the slide as the slide moves vertically, thus providing a horizontal edge to align lettering at any selected vertical position.

In one embodiment the side guides include flaps that are mounted to the sides of the platen and partly overlap each side of the slide. An edge on each side of the slide mates with an edge under the platen to maintain the attitude of the slide as it moves. Indicia in the form of scales printed on the flaps and a horizontal line on the slide permit proper positioning of the slide from line to line in accordance with letter size. Parallel vertical lines on the flat document-mounting surface or on the slide may serve for positioning the indicia horizontally with respect to each other in the same line on the document.

The slide has a longitudinal guideline on it to permit guidelines under the letters of the transfer paper to be aligned with the slide or to permit the top or bottom edges of the lower row of letters to be aligned with the slide for transfer paper not having lines under the letters. The line is on a thin member which is either positioned in close relation with the document-mounting surface or is sufficiently flexible so that it can be bent downwardly to the document-mounting surface. This is to permit the transfer paper to be positioned over the slide where it can be quickly moved to position different letters for transfer without bending the transfer paper upward for alignment with the guideline, such bending having a deleterious effect on the transfer paper.

In some embodiments the guides on opposite sides of the platen and slide are parallel members formed of surfaces that are inclined toward each other and preferably at least one of which is flexible. The inclined surfaces of the slide and the platen fit togehter such as two members of triangular cross sections so as to be self adjusting and prevent binding when moved from place to place.

In use, the document to receive letters is mounted to the flat mounting surface by masking tape, adhesive or the like. The slide is positioned underneath the overlying flaps and moved to a position where lettering is to be done. The center line is used to locate the center of a word and the letters are positioned accordingly starting from the center and locating the bottom line with respect to guidelines on the slide member. The letters are transferred on either side from the center line and then the slide is moved downwardly until the guideline is aligned with an indication on the side flaps indicating the next line.

From the above description, it can be understood that the lettering guide of this invention is portable, relatively simple to operate, accurate in use and inexpensive to construct.

The invention and the above noted and other features thereof will be better understood from the following detailed description when considered with reference to the accompanying drawings in which.

Figure 1:
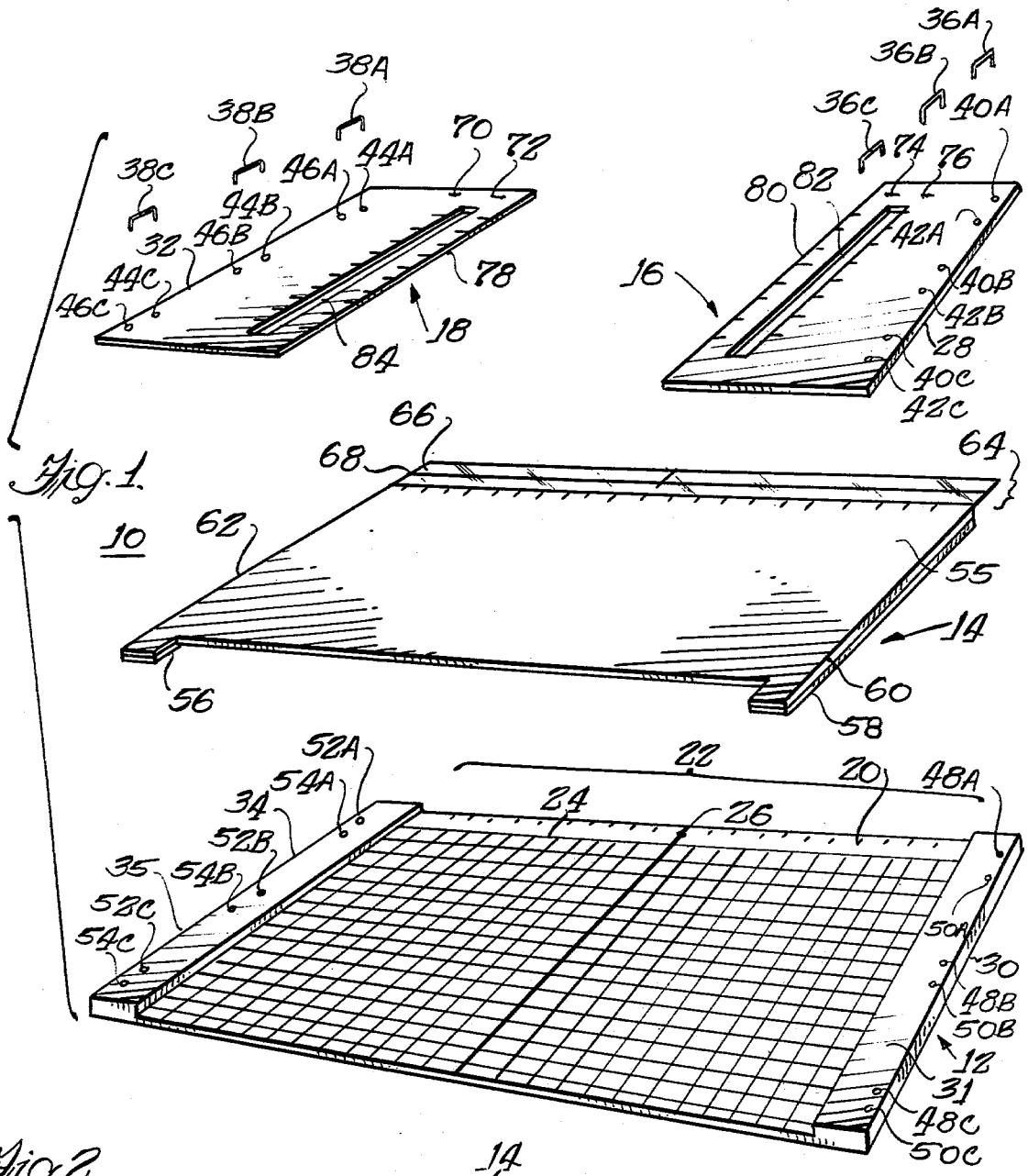
FIG. 1 is an exploded perspective view of an embodiment of the invention.

In FIG. 1, there is shown in an exploded view a lettering guide 10 having a platen 12, a slide 14, and right and left flaps 16 and 18, respectively. The right and left flaps 16 and 18 overlie opposite side portions of the platen 12 and the slide 14. To hold the flaps 16 and 18 in place over the platen 12 and slide 14, each of the flaps 16 and 18 have one edge attached to a different edge of the platen 12. The slide 14 is of such a size as to fit between the platen 12 and the flaps 16 and 18 where it slides vertically during alignment of letters or other indicia on a document mounted to the platen 12.

To provide a surface to which a writing medium such as a poster or document or the like may be fastened for lettering or marking, the platen 12 has a flat upper surface 20 and right and left edges 30 and 34. The surface 20 is of sufficient length to mount conventional posters or documents in a central portion indicated generally at 22 between the inside edges of the right and left flaps 16 and 18. The actual size may vary in accordance with the size of the documents or posters most commonly used but typically would have a width of two and one half feet and a length of one foot and a half.

To aid in positioning different sized documents on the flat surface 20, the central section 22 includes indicia which may be in the form of parallel lines extending in the direction of the length of the platen 12, spaced approximately a quarter of an inch apart and indicated advantageously in inches or other indications such as the mark 24 shown in FIG. 1. A central vertical mark indicated at 26 divides the center portion 22 into two equal portions and serves to locate the center of documents for alignment purposes. The thickness of the platen 12 is selected so that it is convenient to carry and move from location to location. For example a plastic sheet of one or two millimeters is satisfactory.

While in the preferred embodiment, guidelines are used to locate the position to which the document is to be fastened, other types of guides may be used such as strips attached to the surface or different types of markings such as dotted lines or colored sections or the like. Moreover, it is possible to dispense with the markings and permit the user to align by eye or to supply separate overlying sheets which may be fastened to a bottom sheet with individual type markings suitable for different types of documents that are to be printed.

To guide the slide 14 in its vertical motion, an aligning strip 31 and an aligning strip 35 are fastened to the platen 12, with the aligning strip 31 being fastened adjacent to the right edge 30 of the platen 12 and the aligning strip 35 being fastened adjacent to the left edge 34. The strips 31 and 35 each have a different inward edge which edges are straight and match with the edges of the slide 14 in a lengthwise direction so that the slide 14 fits between the strips 31 and 35 and is held in a fixed attitude with respect to the platen 12.

To hold the slide 14 on the platen 12 during use, the right flap 16 has only its right edge 28 fastened to the right edge 30 of the platen 12 and the left flap 18 has only its left edge 32 fastened to the left edge 34 of the platen 12 to enable the unfastened ends of the flaps to overlie the slide 14. In the preferred embodiment, the edges are mounted together by a plurality of staples, three of which are shown at 36A–36C adapted to fasten the right edge of the right flap 16 to the right edge of the platen 12 and three of which are shown at 38A–38C adapted to fasten the left edge of the left flap 18 to the left edge 34 of the platen 12.

The staples are conventional and include a center portion with legs bent perpendicular to it. The legs are forced through the edges of the flaps in a conventional manner to form and fit within staple holes shown separately in FIG. 1 for illustration, with: (1) holes 40A–40C and 42A–42C being in the right edge 28 of the right flap 16; (2) holes 44A–44C and 46A–46C being in the left edge of the left flap 18; (3) holes 48A–48C and 50A–50C being in the right edge 30 of the platen 12; and (4) holes 52A–52C and 54A–54C being in the left edge 34 of the platen 12.

Although staples are used in the embodiment of FIG. 1 to hold the right and left flaps 16 and 18 to the platen 12, many other conventional fastening means may be used instead such as for example glue or the like or the flaps may be formed integrally with the platen 12.

To aid in locating the bottom of the letters, the slide 14 is generally flat and fits between the platen 12 and the right and left flaps 16 and 18 with the flaps resting on the top surface of the slide 14. The slide is sufficiently wide to extend across the center section 22 and underneath the right and left flaps 16 and 18 and to fit against the inner edges of the guides 31 and 35, thus permitting vertical sliding with respect to the platen in a straight line.

To elevate the bottom surface of the slide 14 from the surface 20 of the platen 12, the slide 14 has a generally flat rectangular portion 55, with runners 56 and 58 on its bottom surface, the runner 58 being mounted adjacent to the right edge 60 of the slide 14 and the strip 56 being mounted adjacent to the left edge 62 of the slide 14. The center portion between these runners 56 and 58 is sufficiently wide so that the slide 14 fits over a document fastened in the center section 22 of the platen and slides with respect to it, the runners 56 and 58 being on either side of the document. The runners 56 and 58 have sufficient depth so as to elevate the flat portion 55 from the document in the preferred embodiment.

The upper edge 64 of the flat portion 55 includes a transparent or translucent portion having a white line or translucent line 66 extending across the width of the slide 14 and a black or colored line 68 parallel to it. These lines are intended to be aligned with lines on transfer sheets of transfer lettering with the black line 68 being aligned with a black or colored line on black or colored transfer lettering on a translucent carrier sheet and the line 66 being aligned with a white or plain line for reverse lettering on a colored or black transfer sheet so as to serve as horizontal spacing guides. The top edges or bottom edges of a lower line of letters are used for alignment on transfer paper not having guidelines under the letters, and thus the top or bottom edges of the letters serve as guide indicia instead of a separate guideline.

Because both a colored and translucent line are incorporated on the upper edge 64, one line is visible against the backgrounds of the different colored documents having a black or colored surface and white lettering since the white lettering is generally attached to a dark surface on a poster such as on a black surface which would not show the black line 68 and the colored or black letters are generally put on a white or light colored surface since the white or light line 66 would not show.

Of course, instead of a solid black line 68 or a solid white line 66, other indications may be used such as colored lines, more than two lines in some special embodiments and broken lines or dotted lines. Moreover, it has been found that a single black line is satisfactory as the guideline since it is visible through either light or dark transfer paper. The edge 64 need not be translucent nor transparent.

While runners 56 and 58 along the bottom surface of the slide 14 are shown in the preferred embodiment and an attached translucent edge 64, it is not necessary to have such runners and the slide may slide directly against the document. Moreover, the runners can be placed on the surface 20 if desired or other configurations such as extending abutments or the like may be used instead of runners. Similarly, it is not necessary to have the translucent edge 64 attached to the larger flat portion 55 of the slide 14 but the entire slide may be a translucent or transparent sheet such as a plastic sheet. In such a configuration it may be convenient to have the runners 56 and 58 formed integrally with the plastic sheet.

The edge 64 is a thin flexible member which is easily bent against the surface 20 so that conventional transfer paper may be easily located with the transfer paper guideline under the letter aligned with the guideline 68. The guidelines beneath the letters on transfer paper are conventionally positioned close, such as 1/64th of an inch or 1/32nd of an inch.

To permit the guideline 68 to be sufficiently close to the medium that is to receive the letter: (1) the edge 64 must be thin; (2) the guideline 68 must be close to the edge 64; and (3) the edge must be either movable down to the drawing surface or else permanently located near the drawing surface. These combined dimensions are selected to permit the transfer paper to be properly located with the line under the letter aligned with the guideline 68 on the edge 64, so that the letter may be transferred without unduly crinkling or creasing the transfer paper. It is recommended that the guide edge should be flexible and less than 1/64th of an inch in thickness to permit use with a wide variety of transfer papers.

To aid in positioning the slide 14 for different sizes of dry transfer lettering, the right and left flaps have slots 82 and 84 and lines or gradations or indicia or scales extending along the length of the flap at different locations parallel to each other.

The slots 82 and 84 each: (1) are parallel to the edges 80 and 78 of the flaps; (2) extend partially along the length of the flaps; (3) are spaced inwardly from the edges 80 and 78; and (4) are approximately an eighth of an inch in width.

In FIG. 1 four scales 70, 72, 74, and 76 are shown with: (1) the scale 72 being positioned along the right edge 78 of the left flap 18; (2) the scale 74 being positioned along the left edge 80 of the right flap 16; (3) the scale 70 being positioned adjacent to a slot 84 so that the edge of the slide 14 extends through the slot and the lines 66 and 68 pass under the slot to indicate a selected point division in the scale 70; and (4) the scale 76 being positioned adjacent to a slot 82 extending partially along the length of the right flap 16 so that the right end of the lines 66 or 68 extend adjacent to a scale division to serve as an index for spacing the lines of type one from the other.

Figure 2:
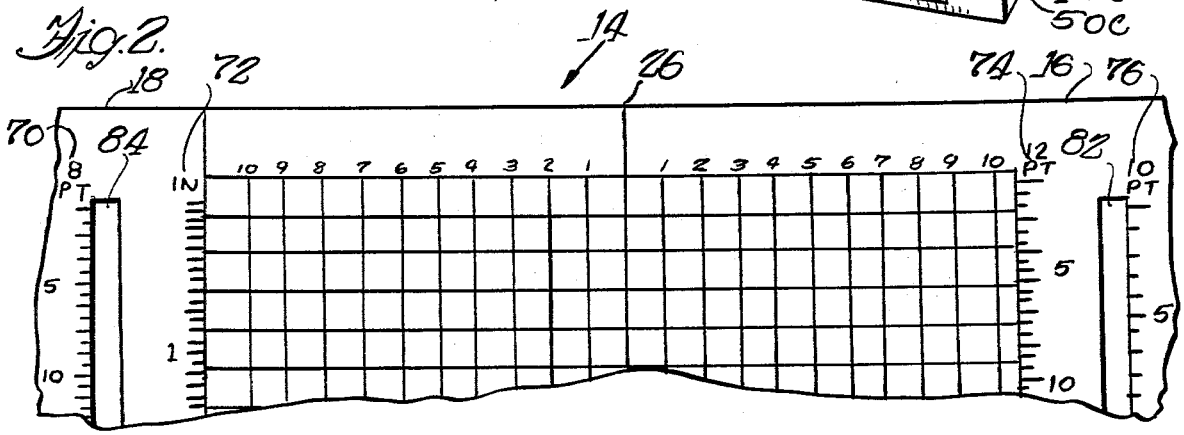
FIG. 2 is an enlarged fragmentary plan view of the embodiment in FIG. 1.

In FIG. 2, there is shown an enlarged fragmentary plan view of the slide 14, the right flap 16, and the left flap 18 showing indicia in the form of parallel lines representing quarter inches or the like. The central vertical mark 26 divides the center portion of slide 14 into two equal portions. The right flap 16 includes two scales 74 and 76, the scale 74 being scaled in six or twelve point divisions and the scale 76 being scaled in ten point divisions. The left flap 18 includes two scales 70 and 72, the scale 70 being scaled in eight point divisions and the scale 72 being scaled in inches.

Figures 3, 4, 5, 6:
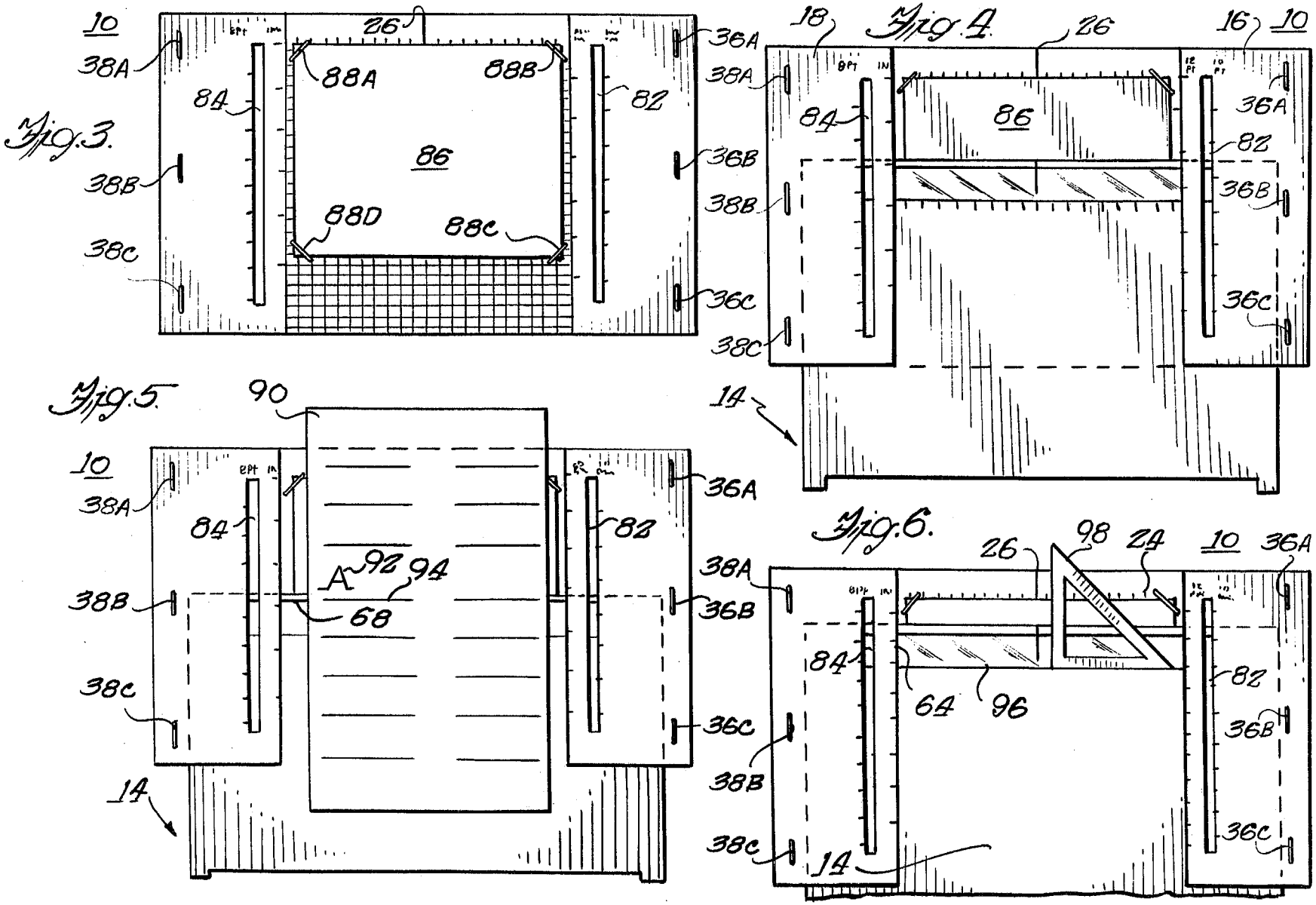
FIG. 3 is a plan view of the embodiment of FIG. 1 in one stage of its operation.
FIG. 4 is a plan view of the embodiment of FIG. 1 in another stage of its use.
FIG. 5 is a plan view of the embodiment of FIG. 1 in still another stage of its use.
FIG. 6 is a plan view of the embodiment of FIG. 1 illustrating another use.

In FIG. 3, there is shown a plan view of the lettering guide 10 without the slide 14 in place but with a document or poster 86 to be lettered fastened in place by masking tape 88A–88D on different ones of its corners. The document 86 may be blank and positioned there to receive lettering or other indicia or may already have some design upon it but requires further lettering.

Although in FIG. 3 the document is shown fastened to the surface by masking tape at its corners, it may be fastened in any other suitable manner such as by sticky surfaces on its bottom side or the surface of the platen 12 may be of a type that sticks to documents.

In FIG. 4, there is shown in a plan view, the lettering guide 10 with the document 86 in place and the slide 14 in place. As can be seen from this figure, the slide 14 is moved so that its upper edge abuts the location where the letters are to be applied, the black or white line being aligned with the line on the transfer paper. The slide 14 may be used to align the document before fastening it down, particularly when the letters are to be parallel to the upper edge of the document. When the slide 14 is used for such alignment, it is inserted under the flaps 16 and 18 prior to taping the document. The document is then aligned with the slide 14, after which the slide is removed and the document taped in place. The slide is then replaced.

In FIG. 5, there is shown the guide 10 with the transfer paper 90 in place for the printing of the letter "A" shown at 92. With the transfer paper in place and the letter aligned, the back is rubbed to transfer the letter to the document.

In locating the letter it is customary to count the number of letters in the word to be printed and center the center of the word on the center mark indicated at 26 in FIG. 1. For example, the letter "A" is aligned by placing the transfer paper over the slide 14, with the line 68 aligned with a line 94 under the letter "A". This line is provided on commercial transfer paper. The line is located over line 68 when the letters are black but over the line 66 for reverse lettering. The letters may then be spaced in both directions to complete the word.

After a word has been completed, the slide 14 may be moved downwardly until the lines 66 or 68 are aligned with the next location for lettering. If the letters are consecutively placed one under the other for eight point type, the eight point scale will be used and the line moved down one point. For sixteen point type, a multiple of eight points may be used and it may be moved down two points. Accordingly, the lines may be spaced a conventional distance one from the other for a designated size type. Normally the transfer sheets are so designated. Suitable transfer sheets with letters may be obtained from Geographic Inc., 2339 South 2300 West, Salt Lake City, Utah, 84119, and are sold under the trademark GEOTYPE.

In FIG. 6, there is shown the guide 10 as it may be used to space letters one from the other conveniently. In this embodiment, the slide 14 has a ledge 96 adjacent to the edge 64 upon which a draftsman triangle 98 rests with one of two ninety degree sides of the triangle resting upon the ledge 96 and its other end aligned with pica marks 24. The triangle may be used to outline the spacing of letters by moving it from pica to pica mark and drawing guide lines. With this procedure, layouts or "comps" may be quickly made.

In the embodiment of FIGS. 1–6, the slide may be turned upside down to provide a convenient surface for the triangle to rest. When inverted in this manner, a scale in inches is provided for the convenience of the user in making layouts with the triangle. However, other devices for providing a convenient resting place for the triangle may be used as is explained hereinafter.

Figure 7:
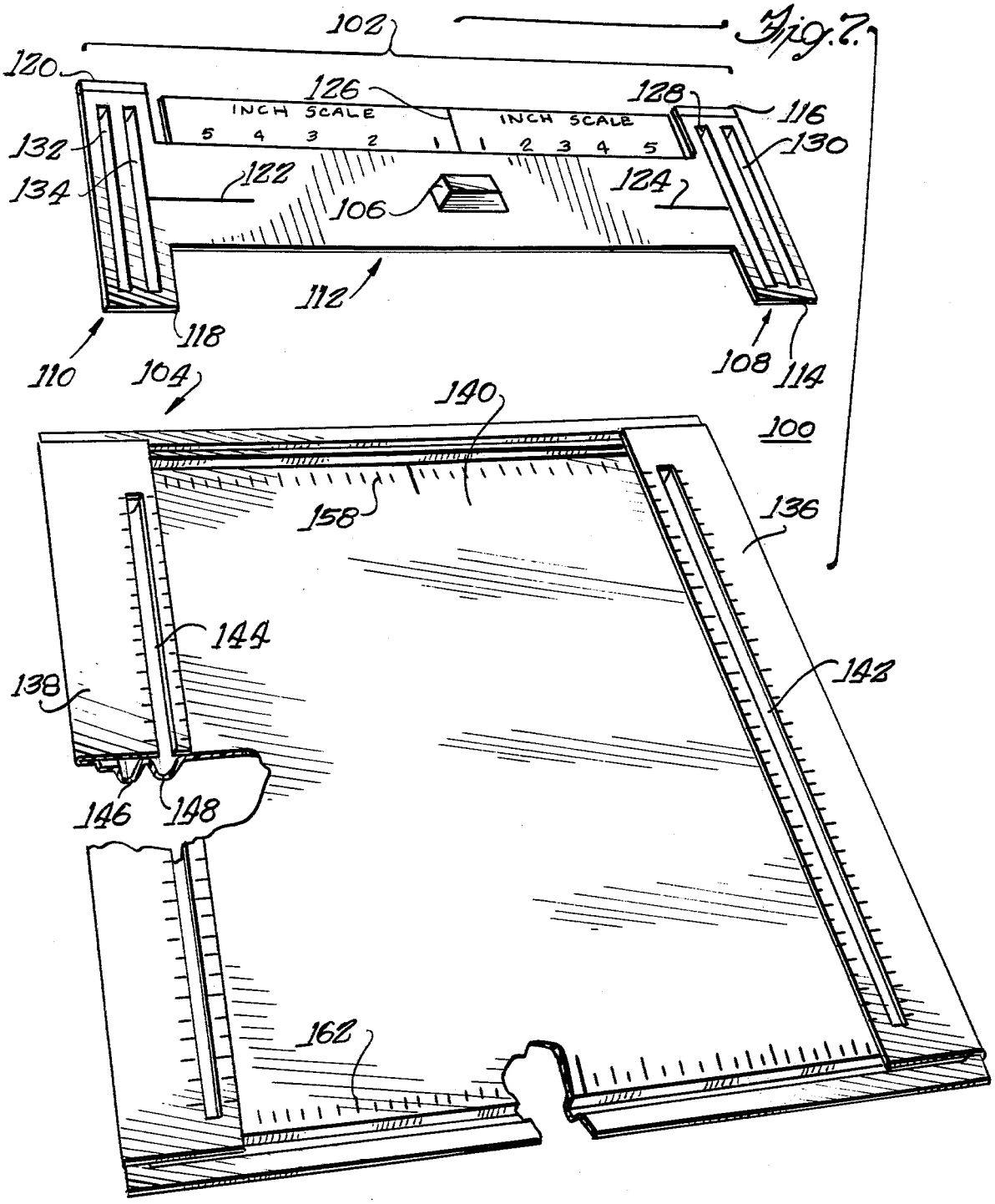
FIG. 7 is an exploded perspective view, partly broken away of another embodiment of the invention.

In FIG. 7, there is shown an exploded perspective view, partly broken away, of another embodiment of lettering guide 100 having a slide 102 and a platen 104, both made of polystyrene or other suitable plastic material. In this embodiment, the slide 102 is conveniently vacuum or die formed from sheet plastic and has a formed handle 106 extending from its center portion.

Right and left runner members 108 and 110 extend from a center member 112 upon which the handle 106 is formed. The right and left runner members 108 and 110 are generally shaped in plan view as parallelopipeds having parallel bottom and top edges, the runner member 108 having a bottom edge 114 and a top edge 116 and the runner member 110 having a bottom edge 118 and a top edge 120. The bottom and top edges in an embodiment are approximately one and one quarter inches long. Outer side edges of the runner members are parallel and approximately five and one half inches long. The center member 112 is four inches wide so that the runner members extend out beyond it three quarters of an inch on either side. In this embodiment, the distance from the center line of the runner member 108 to the center line of the runner member 110 is approximately 13⅝ inches. Of course, these dimensions are selected to match the dimensions of the platen 104 and may vary from embodiment to embodiment.

Along the longitudinal center line of the center portion 112 are guidelines 122 and 124 aligned with each other and extending outwardly into the runner members 114 for a purpose to be explained hereinafter. On the top edge of the center member 112 is an inch scale with a center line 126 and dimensions in inches extending in either direction from it.

Extending along the right runner member 108 are two trapezoidal cross-section guide ribs 128 and 130 pressed downwardly in the runner and in the left runner 110 are two corresponding trapezoidal guide ribs 132 and 134. The guide ribs 128, 130, 132 and 134 are parallel to each other and to the edges of the runners.

The platen 104 includes a right flap 136 and a left flap 138 overlying a central document-holding portion 140. The right and left flaps each have in them a corresponding one of the two longitudinal slots 142 and 144 with scales extending longitudinally on either side in a manner similar to the embodiment of FIGS. 1–6. However, underneath each of the flaps 136 and 138 are two different pairs of trapezoidal cross-section guide troughs, one pair being shown under the left flap 138 at 146 and 148. These guide troughs are of a shape to receive the trapezoidal guide troughs 128–134 of the slide 102.

Each of the troughs have surfaces which are inclined toward each other and the troughs of the slide fit within the troughs of the platen. With this configuration the troughs are self adjusting along their tapered surfaces so that changes in the angle of the surfaces does not cause misalignment to any extent but only shifts the distance that one trough fits into the other. Of course, trapezoidal troughs are not necessary since any inclined surfaces, whether curved or straight, may be used. The self-adjustment is desirable to prevent binding in economically manufactured equipment. For precision using guides of each side of the cursor, a reasonably long contact surface is needed. However, equipment manufactured economically normally has some free play. When the cursor is moved by applying force at a point not centered on the cursor, the cursor tends to tilt because of the free play and this tilting, if the sides are straight and not self adjusting, permits a corner of the cursor to dig into its mating surface and bind. However, by having two of the mating surfaces at an angle, the cursor is able to momentarily rise on the inclined surface so that it is sufficiently loose to move freely.

For best results, guide surfaces on both sides of the cursor should extend downwardly and outwardly and should mate with corresponding inclined surfaces on the platen. The angle of inclination depends on the amount of free play, the lengths of the mating surfaces, their smoothness and their flexibility. It is generally determined experimentally. Upward movement of the cursor should be limited so that it only rises a sufficient amount to free the cursor from binding.

The guidelines 122 and 124 of the slide member extend underneath the flaps 136 and 140 so that they may be seen through the slots 142 and 144 and thus serve to indicate the position of the slide 102 in a manner similar to that of the embodiment of FIGS. 1–6.

Figure 8:
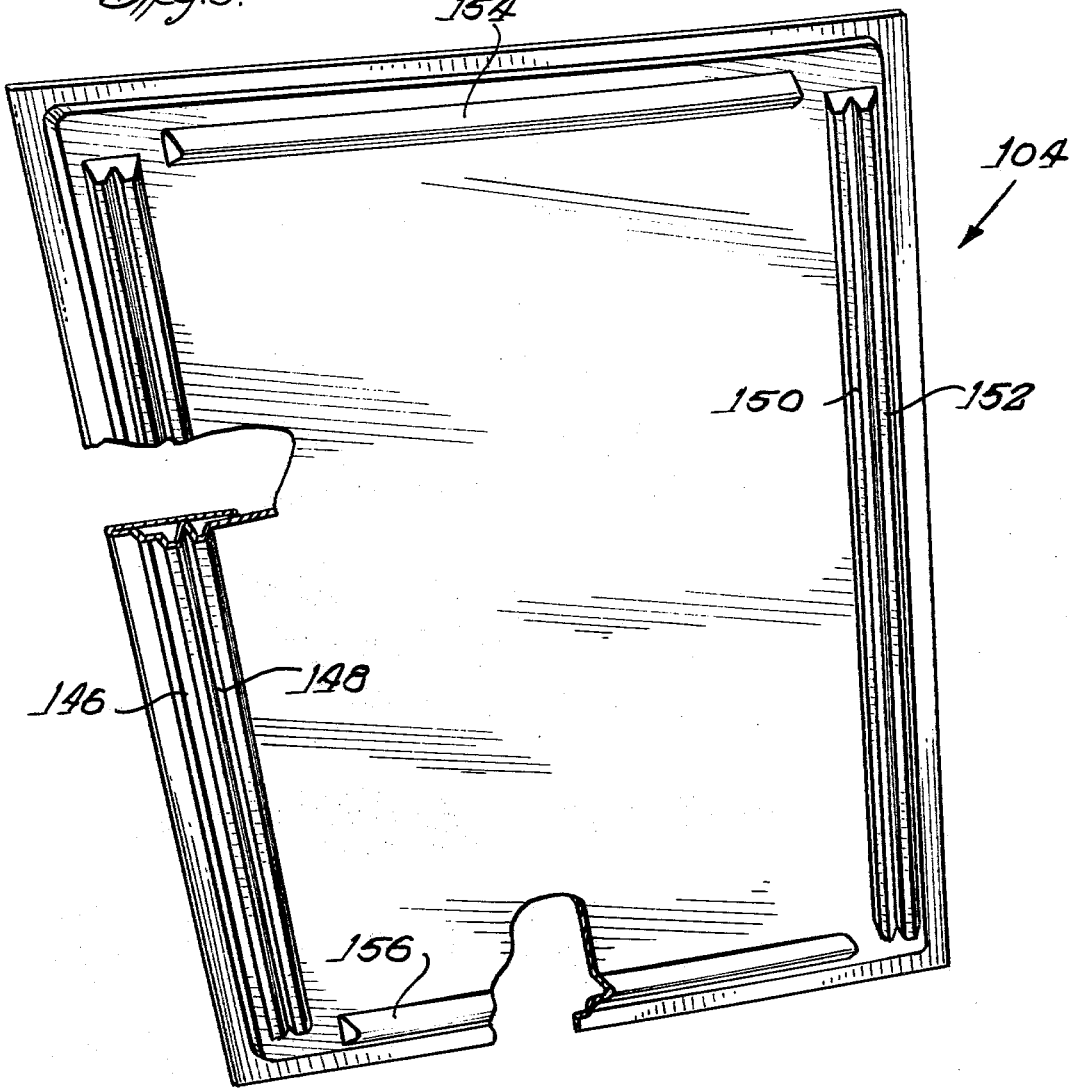
FIG. 8 is a perspective view partly broken away of the embodiment of FIG. 7.

In FIG. 8, there is shown a bottom view of the platen 104 showing the guide troughs 146, 148, 150 and 152 as well as support member 154 and 156 which extend beneath the bottom of the platen 104 to the same depth as the guide troughs 146–152 so as to form four supports for the platen. Also on the reverse side they form a depression which may serve to hold pencils or the like.

Figure 9:
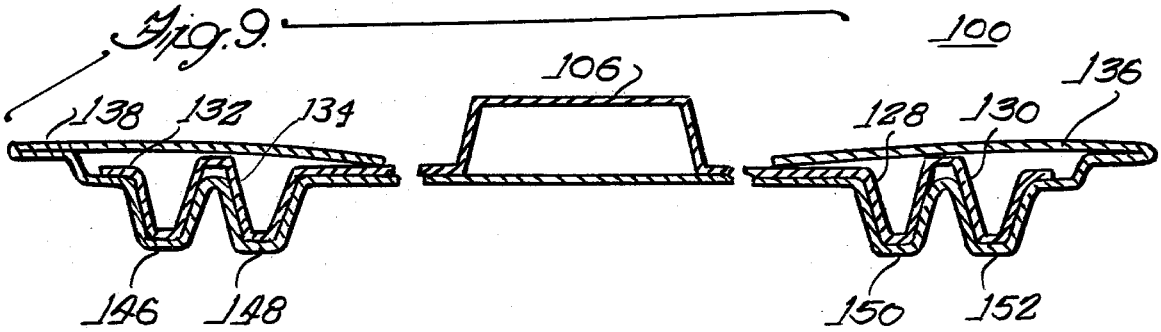
FIG. 9 is a sectional view, partly broken away of the embodiment of FIG. 7.

In FIG. 9, a broken-away cross-sectional view of the lettering guide 100 is shown illustrating the manner in which the guide troughs and guide ribs 128–134 and 146–152 respectively fit within each other so as to provide alignment for the slide as it moves up or down against the platen. With this arrangement, the slide is maintained aligned regardless of its height above the platen so long as edges of the guide troughs and ribs are in contact. Consequently, a horizontal line may always be drawn correctly without fear of misalignment.

It can also be seen that while the lettering guide of FIGS. 7–9 is substantially the same as that of FIGS. 1–6 it is sturdier since it is formed of 0.080 polystyrene. It may be used for layout with the ruler against the bottom edge of the slide and the platen inverted or used for lettering when positioned in the opposite direction without removing the slide.

At the top of the platen it includes a scale 158 in picas with zero at the center for ad width, an inch scale at 160 on the right-hand side and 6–12 point and agate line scales adjoining the slots 142 for line distances and a two direction pica scale at 162 for ad layout.

The extended portions 108 and 110 may of course be modified so that they do not extend beyond the bottom edge of the center member 112 opposite to the inch scales and the side having the guidelines. This permits the slide to be moved further down on the board to provide a larger work area. Moreover, instead of removing and reinserting the slide for layout work such as that described above in connection with FIG. 6, the entire board may be inverted so that a triangle may rest upon the edge 112.

While the embodiments of FIGS. 1-9 are conveniently fabricated of cardboard, paper or vacuum-formed plastic, suitable apparatus may also be formed by other techniques such as by aluminum extruding, injection molding and the like. Moreover, the platen may be a sheet of plastic or masonite or the like inserted into extruded or injection-molded end units rather than being a vacuum-formed plastic sheet or a cardboard sheet with flaps stapled to it. For example, an aluminum extruding may be manufactured to hold the platen at its lower portion within two insertable fingers and to hold the side flaps in two other fingers. Other edges may be formed of aluminum extruding in a convenient economical manner.

It is also possible to dispense with the side flaps entirely by placing on the platen or support the dimensions corresponding to the scales 70, 72, 74 and 76 in FIG. 1 to indicate the selected point divisions for positioning the slide. Consequently, pointers on the slide or lines are used over a translucent or open portion to align the slide with the scales printed on the platen. This is just the inverse relationship from that shown in the embodiments of FIGS. 1-9 but obviously works in substantially the same manner.

In such an embodiment, the slide may include raised end portions with downwardly extending runners near the end that fit into complementarily formed portions in the platen to permit the slide to be inserted into the platen and to run smoothly, parallel to side guides. Moreover, the edge bearing the floating guideline for aligning with the marks on transfer paper beneath the characters or letters may be conveniently inserted near the bottom of the slide adjacent to the platen.

In such an embodiment, the bottom of the slide is recessed near the edge to receive an elongated plastic sheet, which may be held in place by plastic tape or the like which also provides a bearing surface between the slide and platen. In this embodiment, the plastic guide is positioned adjacent to the platen and thus requires less flexibility to permit the transfer paper to rest smoothly on the edge of the guide with its guideline for letters aligned with the floating guideline on the slide and with the character to be transferred positioned over the document fastened to the platen without crinkling the transfer paper.

As can be understood from the above description, the lettering guide of this invention has several advantages such as: (1) it is simple in construction and inexpensive; (2) it is easy to use and may be used by an unskilled person to prepare printing without the need of a drawing board and other types of aligning equipment used by professionals; and (3) it is adaptable to a number of general purpose uses.

What is claimed is:

1. Apparatus comprising:

first and second members mounted for movement with respect to each other and having right and left sides;

said first member including support means for supporting a medium upon which characters are to be transferred from transfer paper of the type having characters with transfer paper guide indicia beneath the characters;

said support means including a flat surface adapted to receive the medium upon which the characters are to be transferred;

said second member including slide means movably mounted to said support means;

said slide means including a guide edge;

said guide edge including a thin member with slide guide indicia upon it;

said guide member being sufficiently thin and said slide guide indicia being positioned so that the distance between the edge of the guide member and the slide guide indicia and the thickness of the guide member is less than the distance between the letter on the transfer paper and the nearest guide indicia underneath the character.

2. Apparatus according to claim 1 in which said guide edge is positioned adjacent to said support member.

3. Apparatus according to claim 1 in which said guide member is flexible and said slide means is rigid, whereby said slide means may move over said support medium and said guide means be bent downwardly against said support medium.

4. Apparatus according to claim 1 in which said slide means includes:

parallel guide edges on opposite sides; and said means for supporting includes complementary guide means matching with said guide means of said slide member.

5. Apparatus according to claim 4 in which said slide means includes a portion capable of passing light and a straight indicia on said portion perpendicular to the direction of motion of said slide means.

6. Apparatus according to claim 5 in which said first and second memebers are spaced from each other a sufficient distance for mounting of said document and the surface therebetween includes guide indicia moving parallel to the edges of said first and second members.

7. Apparatus according to claim 2 in which said slide means includes:

parallel guide edges on opposite sides; and said means for supporting includes complementary guide means matching with said guide means of said slide member.

8. Apparatus according to claim 3 in which said slide means includes:

parallel guide edges on opposite sides; and said means for supporting includes complementary guide means matching with said guide means of said slide member.

9. Apparatus comprising:

first and second members mounted for movement with respect to each other and having right and left sides;

said first member including support means for supporting a medium that is to receive transfer letters from transfer paper;

said support means including a flat surface adapted to receive said medium;

said second member including slide means movably mounted to said support means;

mounting means for movably mounting said slide means to said support means;

said mounting means comprising at least a part of one of said first and second members;

said mounting means including two parallel right-hand guide means and two parallel left-hand guide means for guiding said first and second members with respect to each other;

each of said first and second parallel right-hand guide means and first and second parallel left-hand guide means including two complimentary edges, one being part of said first member and the other being part of said second member;

one of said first and second members having gradations and the other having an index whereby the position of said slide means with respect to said support means is indicated;

said slide means having a guide indication extending across its length for alignment of said transfer paper;

said slide means including a portion capable of passing light and a straight indicia on said portion perpendicular to the direction of the motion of said slide means with respect to said support means, whereby said straight indicia serves as said guide means for alignment of said transfer paper; and each of said two guide means being a different surface and said different surfaces being inclined toward each other.

10. Apparatus according to claim 9 in which said different surfaces are opposite surfaces of a trough.

* * * * *

UNITED STATES PATENT AND TRADEMARK OFFICE

CERTIFICATE OF CORRECTION

PATENT NO. : 4,183,143

DATED : January 15, 1980

INVENTOR(S) : Raymond Charles Root

It is certified that error appears in the above-identified patent and that said Letters Patent are hereby corrected as shown below:

column 2, line 28, change "togehter" to "together".

column 10, line 3, after the semicolon, add the word "and".

column 10, line 66, change "complimentary" to "complementary".

Signed and Sealed this

*Fifteenth* Day of *April 1980*

[SEAL]

*Attest:*

SIDNEY A. DIAMOND

*Attesting Officer*

*Commissioner of Patents and Trademarks*